United States Patent [19]

Harydzak et al.

[11] Patent Number: 4,586,230

[45] Date of Patent: May 6, 1986

[54] PORTABLE PULLING APPARATUS

[76] Inventors: Richard Harydzak, 201 Brierwood Dr.; J. Alan Kraykovic, 11021 Azelea Dr., both of Pittsburgh, Pa. 15235

[21] Appl. No.: 630,826

[22] Filed: Jul. 13, 1984

[51] Int. Cl.[4] ..... B21C 1/12; B21B 33/00; B25D 17/06

[52] U.S. Cl. ..... 29/254; 29/275; 72/450; 72/458; 72/705; 173/46; 173/91

[58] Field of Search ..... 72/392, 450, 453.01, 72/458, 705; 254/1, 18, 19; 173/46, 91, 128, 131, 132; 29/239, 244, 246, 252, 255, 259, 267, 275, 280, 243.58, 258, 262, 254

[56] References Cited

U.S. PATENT DOCUMENTS

| | | | |
|---|---|---|---|
| 839,264 | 12/1906 | Bossert | 72/390 |
| 1,024,173 | 4/1912 | Betts | 29/254 |
| 1,042,873 | 10/1912 | Betts | 254/29 R |
| 1,553,171 | 9/1925 | Jones | 29/280 |
| 1,604,958 | 11/1926 | Bayles | 279/4 |
| 1,829,696 | 10/1931 | Wylie et al. | 72/391 |
| 2,322,464 | 6/1943 | McKee et al. | 29/262 |
| 2,561,577 | 7/1951 | Knudsen | 173/132 |
| 2,738,748 | 3/1956 | Hecht | 113/38 |
| 2,921,368 | 1/1960 | De Lucia | 29/244 |
| 3,289,287 | 12/1966 | Guritz | 29/275 |
| 3,579,795 | 5/1971 | Burman | 29/252 |
| 3,602,032 | 8/1971 | Skintzis | 29/243.58 |
| 3,742,568 | 7/1973 | Hahlbeck | 29/252 |
| 3,777,687 | 12/1973 | Colman, Jr. | 29/243.58 |
| 3,791,004 | 2/1974 | Crafford | 29/200 |
| 4,074,554 | 2/1978 | Summerlin | 72/114 |
| 4,527,328 | 7/1985 | Moody et al. | 29/758 |

*Primary Examiner*—Lowell A. Larson

*Attorney, Agent, or Firm*—Buell, Ziesenheim, Beck & Alstadt

[57] ABSTRACT

A compact and portable pulling apparatus is disclosed. The apparatus includes a housing having a bore therein through which a plunger attached to a reciprocating bit of an attached air chisel may pass. Pivotally attached to the housing is a compact linkage mechanism which preferably has only two pairs of link elements. One end of the linkage mechanism is positioned to abut an end portion of the plunger and an opposite end is attached to a connecting yoke whereby an outward thrust of the air chisel bit causes the connecting yoke to be pulled inwardly. The connecting yoke is designed to attach any one of a number of various gripping or holding mechanisms to the pulling apparatus which may be required for any particular application. A method of applying a pulling force to an object is also disclosed.

13 Claims, 5 Drawing Figures

PORTABLE PULLING APPARATUS

BACKGROUND OF THE INVENTION

1. Field Of The Invention

This invention relates to a portable pulling apparatus. More specifically, a pulling apparatus having novel linkage means and end connections is adapted for connection to and operation by a hand held air chisel or the like.

2. Description Of The Prior Art

Various types of extractor devices are known in the art.

U.S. Pat. No. 1,604,598, for example, discloses a hand held hammer-type extractor which may be used for extracting rods, pins or tools from the means which may be holding them. That invention includes two relatively movable impact members in a hammer cylinder, one of which is provided to grip or hold the rod or pin to be extracted, the other member being actuated by fluid pressure to impart blows of impact in a rearward direction directly to the pin carrying member. That device, however, would most likely be relatively expensive to manufacture because of its complexity. Additionally, it is a self-contained unit rather than an attachment for an existing air chisel capable of other uses.

U.S. Pat. No. 1,042,873 discloses another extractor device utilized for removing drill bits from holes. That device may be operated by compressed air and utilizes a single pivot lever attached to a fulcrum pin to obtain the leverage needed to withdraw a drill bit. Because of the configuration of that device, it is not suitable for use in areas of limited space.

Various types of linking mechanisms designed to provide an inwardly directed pulling action resulting from an outwardly directed applied force are also known in the art.

U.S. Pat. Nos. 1,829,696 and 2,738,748, for example, each disclose linkage mechanisms which accomplish that objective. Each of these linking mechanisms, however, includes a relatively large number of components and requires a relatively large working area.

There remains a need, therefore, for a portable pulling apparatus or extractor which is simple in design and relatively inexpensive to manufacture. There further remains a need for a pulling apparatus which may be attached to existing hand held air chisels and the like. There still further remains a need for a pulling apparatus which is compact for use in areas of limited space. Finally, there remains a need for an extractor or pulling apparatus which includes a compact and relatively simple linkage mechanism having a minimum number of components to provide a pulling action from an applied pushing force.

SUMMARY OF THE INVENTION

The present invention provides a solution to the above-mentioned problems by providing a portable pulling apparatus which is adapted to be attached to an air chisel or the like. The present invention may be used, for example, for pulling dents out of the body of an automobile, for extracting bearings or for any application where a pulling force is required, particularly where access from the rear may be restricted. The invention includes a housing which is adapted for attachment to an air chisel and which has a bore therein through which a plunger attached to a reciprocating piston of the air chisel may pass. A compact linkage means, which preferably has only two pairs of link elements, is pivotally attached to the housing. An impact end of the linkage means is positioned to abut the plunger and an opposite end is attached to a connecting means whereby an outward thrust of the air chisel piston causes the connecting means to be pulled inwardly. The connecting means is designed to attach any one of a number of various gripping or holding mechanisms which may be required for any particular application.

A method of applying a pulling force to an object according to the present invention comprises the steps of providing a linkage means and housing assembly wherein the linkage means has a second end which is pulled inwardly by an outwardly directed force applied to a first end thereof; attaching the first end of said linkage means to an air chisel or the like of the type having a reciprocating piston in a manner to provide a series of outwardly directed forces to said first end; and attaching the second end of said linkage means to the object to be pulled.

It is an object of the present invention to provide a portable pulling apparatus or extractor which is simple in design and inexpensive to manufacture.

It is another object of the present invention to provide a portable pulling apparatus which may be attached to existing hand held air chisels and the like.

It is yet another object of the invention to provide a pulling apparatus which is compact thereby making it useful for applications in areas of limited space.

It is yet another object of the invention to provide a pulling apparatus which includes a relatively simple linkage mechanism having a minimum number of components to provide an outwardly directed pulling action from an applied inwardly directed pushing force.

It is a further object to provide such a linking mechanism which is compact.

It is yet another object of the invention to provide a novel method of applying a pulling force to an object.

These and other objects of the invention will be more fully understood from the following description of the presently preferred embodiments of the invention on reference to the illustrations appended hereto.

DESCRIPTION OF THE PREFERRED EMBODIMENTS

Figure 2:
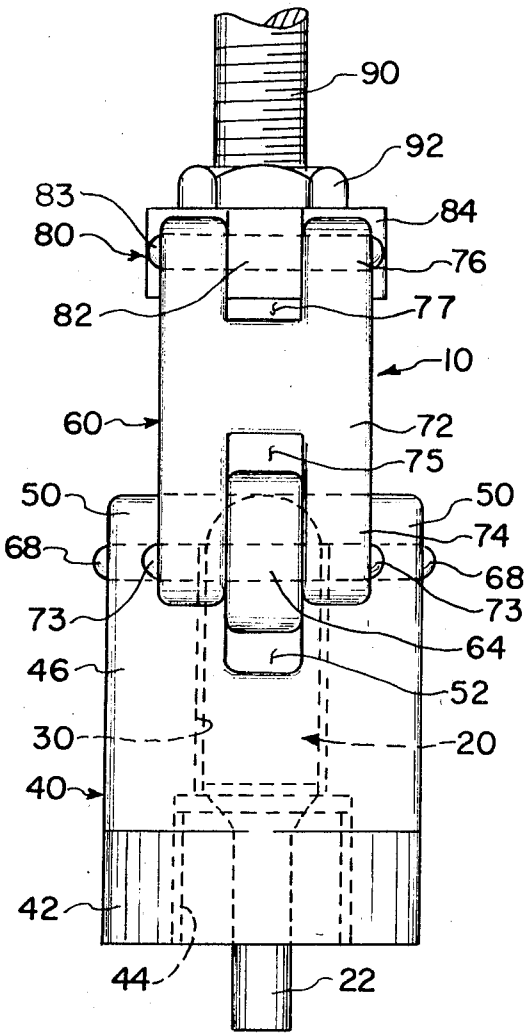
FIG. 2 is an end elevational view of the pulling apparatus of FIG. 1.
Figure 1:
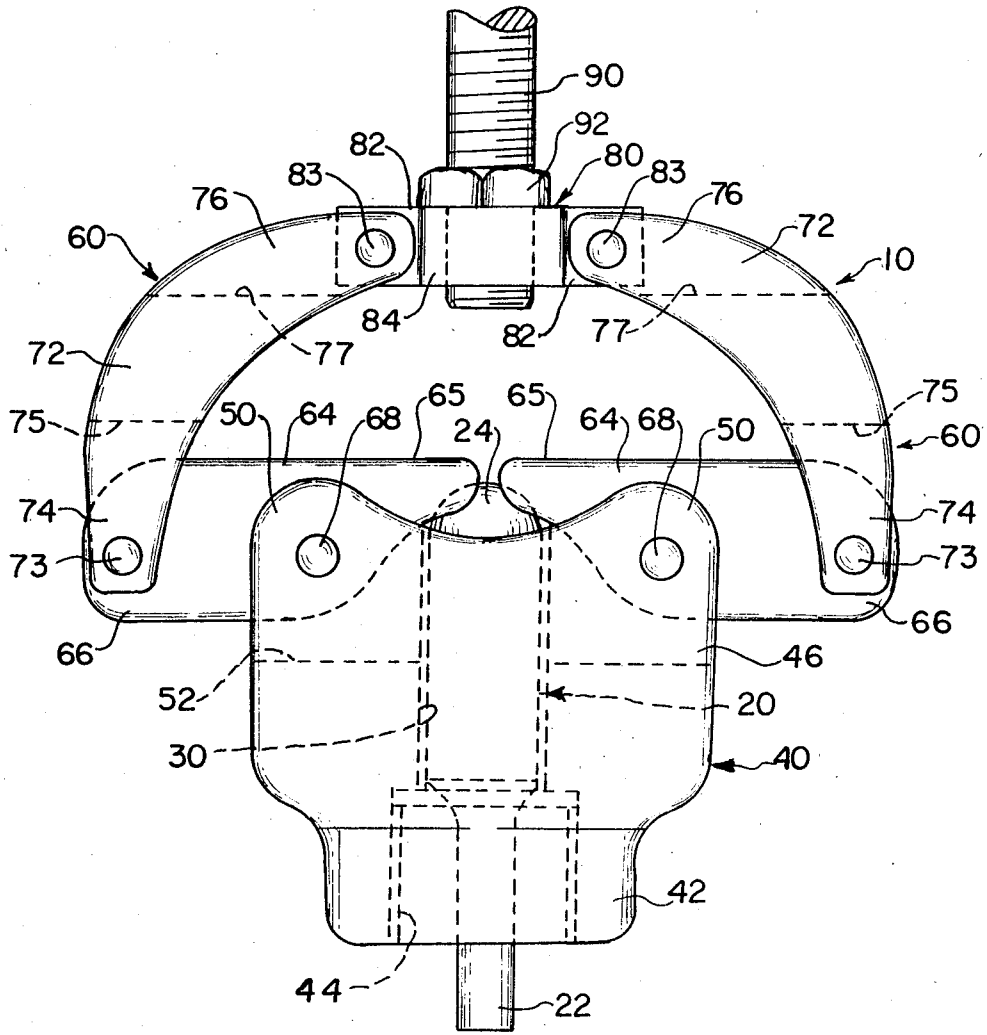
FIG. 1 is a side elevational view of a pulling apparatus accoring to the present invention.
Figure 3:
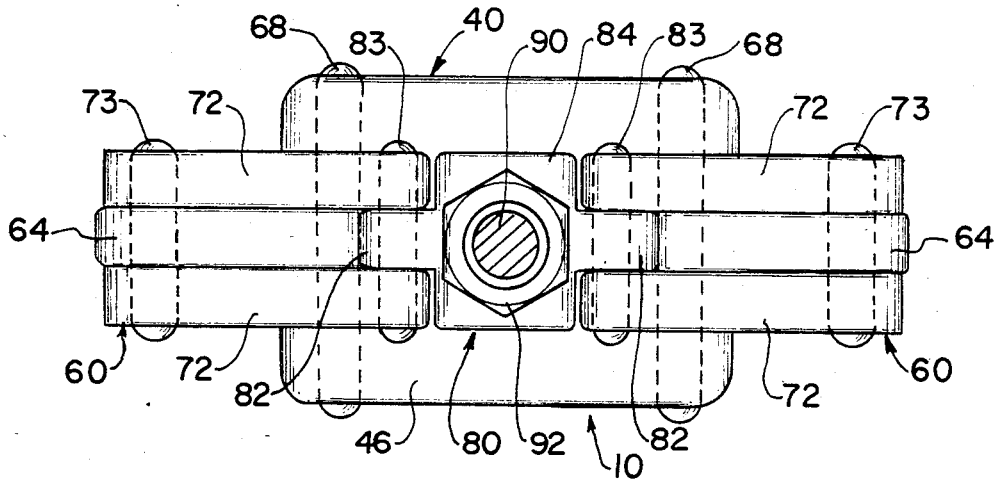
FIG. 3 is a top plan view of the pulling apparatus of FIG. 1.
Figure 4:
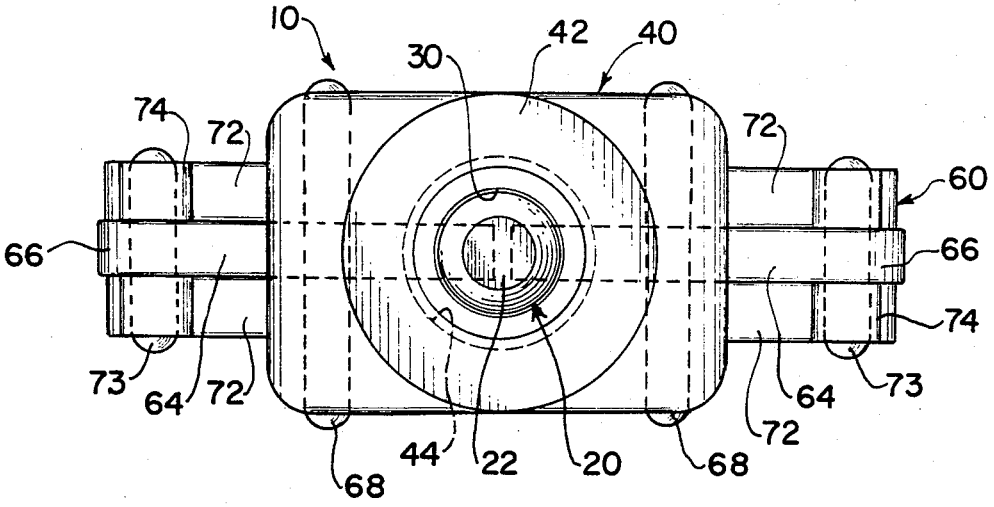
FIG. 4 is a bottom plan view of the pulling apparatus of FIG. 1.

As used herein, the terms "outward" and "outwardly" refer specifically to the direction of a pushing force applied to the plunger by a reciprocating piston of an air chisel or the like. As shown in FIG. 1, for example, upper end 24 of plunger 20 moves "outwardly" when it moves vertically upward to a location further away from housing 40.

Likewise, the terms "inward" and "Inwardly" refer specifically to the direction diametrically opposed to an "outward" direction. In FIG. 1, for example, connecting means 80 moves "inwardly" when it moves vertically downward to a location closer to housing 40.

For convenience, the present invention is described herein as being attachable to an air chisel. It is to be distinctly understood, however, that the invention is not limited thereto and may also be adapted for connection to any type of power or hand tool having a reciprocating means, such as a hydraulically or electrically operated tool, for example.

Referring to the FIGS. 1 through 4, a portable pulling apparatus 10 according to the present invention is shown. In its simplest form, the invention includes a plunger 20, a housing 40, linkage means 60 and connecting means 80.

Figure 5:
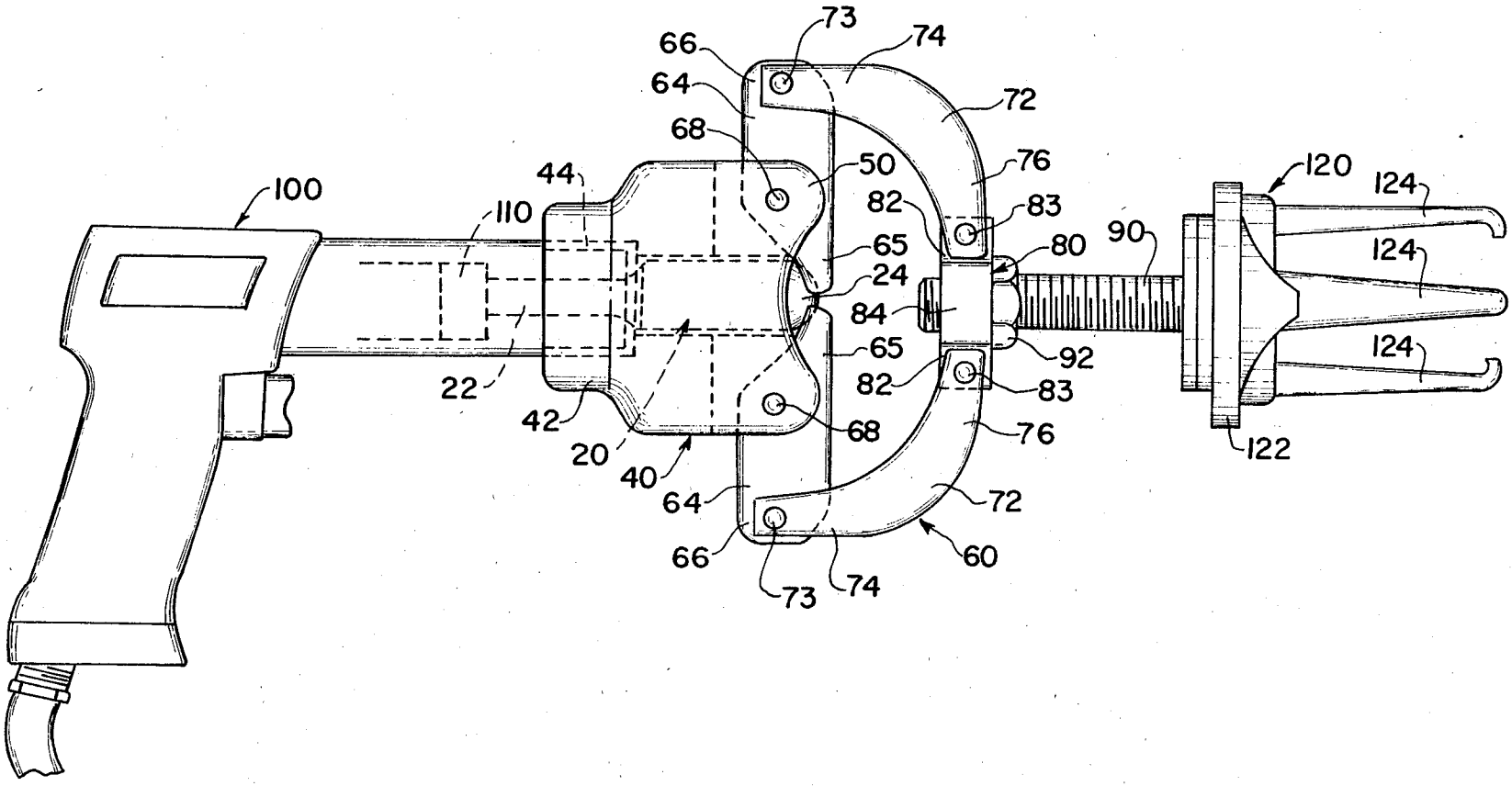
FIG. 5 is a side elevation view of the pulling apparatus of FIG. 1 with an air chisel and gripper attached.

Plunger 20 is an elongated member preferably having a generally circular cross-sectional configuration. The plunger, as shown, is vertically aligned with and is placed within a bore 30 provided vertically through a substantially centered portion of housing 40. Lower end 22 of plunger 20 is adapted for attachment to a reciprocating piston 110 of an air chisel 100 or the like (FIG. 5). Plunger 20 under the force of the reciprocating piston reciprocates vertically within bore 30 of housing 40. Upper end 24 of plunger 20 is positioned so that it will project outwardly from an upper opening of bore 30 at least during a portion of each outward (upward as shown in FIG. 1) thrust of the piston.

A lower portion or end 42 of housing 40 is provided with a threaded bore 44 or other suitable means for attaching a hand held air chisel or the like to said housing. Upper portion or end 46 of housing 40 is provided with a pair of upwardly extending portions or ears 50 to which link means 60 are pivotally attached to housing 40 by means of pivot pins 68. Housing 40 has a groove 52 (FIG. 2) extending substantially through the center of upper portion 46 of housing 42 which is sized to receive a portion of a first link pair 64 of link means 60.

Link means 60 preferably is comprised of first and second pairs of link elements 64 and 72. Links 64 are each elongated members which extend substantially horizontally outwardly from projecting end 24 of plunger 20 when said plunger is oriented vertically, as shown. Each link 64 has an impact end 65 and an opposite end 66. Impact end 65 of each link 64 preferably has a recess therein adapted to receive at least a portion of projecting end 24 of plunger 20. Link members 64 are each provided with a bore (not shown) at a location between ends 66 and 65 thereof. A portion of each link member 64 is adapted to be received within groove 52 of housing 40 and link members 64 are pivotally connected to housing 40 by means of pivot pins 68. An additional bore is provided at ends 66 of links 64 to facilitate pivotal attachment of link elements 72 thereto.

Links 72 are each arcuate members which extend substantially vertically upward from ends 66 of links 64 and then curve toward a line defined by the path of travel of piston 110 to a substantially horizontal orientation at which point ends 76 thereof are attached to connecting means 80. Ends 74 of links 72 are pivotally attached to ends 66 of links 64 by means of pivot pins 73. Ends 76 of links 72 are pivotally attached to mounting ears 82 of connecting means 80 by means of pivot pins 83. End 74 of each link 72 is provided with a groove 75 therein sized to receive end 66 of link 64. Similarly, end 76 of link 72 is provided with a groove 77 sized to receive ears 72 of connecting means 80.

The connecting means of the present invention preferably comprises a yoke member 84 having ear portions 82 extending outwardly therefrom and having a threaded bore therein (not shown) sized to receive a threaded rod 90 therein. A jam nut 92 may be provided to secure shaft 90 in abutting relationship with respect to yoke 84. It is to be understood that rod 90 may be a part of or attached to any one of a plurality of various gripping or holding means. One gripper, for example, 120 is shown in FIG. 5 and includes a body portion 122 and a plurality of fingers 124.

In use, as plunger 20 is urged outwardly by an attached piston of an air chisel, impact ends 65 of link members 64 are forced upwardly (FIG. 1) pivoting about pivot pins 68. Opposite ends 66 are thereby directed downwardly and act to pull the link members 72 and connecting means 80 inwardly along a path which is collinear with a path of travel of piston 110. As mentioned above, the present invention may be utilized for such operations as the removing of dents from automobile bodies, the pulling of bearings or for any type of operation requiring a pulling action.

It will be appreciated, therefore, that the present invention provides a portable pulling apparatus or extractor which is simple in design and inexpensive to manufacture. It further provides a pulling apparatus which may be easily attached to an existing hand held air chisel or the like. Finally, the present invention provides a pulling apparatus which is compact by utilizing a novel linking means having only two pairs of linking elements.

While we have shown and described certain presently preferred embodiments of the invention, it is to be distinctly understood that the invention is not limited thereto but may be otherwise embodied within the scope of the following claims.

We claim:

1. A portable pulling apparatus for attachment to hand held air chisels and the like of the type having a reciprocating piston utilized to provide a series of outwardly directed impact thrusts comprising:

(a) a plunger adapted for attachment to a reciprocating piston of an air chisel;

(b) a housing adapted at one end thereof for attachment to said air chisel and having a bore therethrough sized to receive said plunger, said plunger being attached to said piston in a manner allowing one end of said plunger to project from an opposite end of said housing at least during a portion of an outward thrust of said piston;

(c) linkage means pivotally attached intermediate its ends to said housing adjacent said one end of said plunger in a manner providing an impact end of said linkage means to extend at least partially over said one end of said plunger whereby said one end of said plunger impacts the impact end of the linkage means with each outwardly directed thrust of said piston; and (d) connecting means pivotally attached to an opposite end of said linkage means whereby said linkage means causes the connecting means to be pulled inwardly with each outward directed impact thrust of said piston and attached plunger along a path which is substantially collinear with a path of travel of said piston.

2. A pulling apparatus according to claim 1 wherein said linkage means further comprises a first and second pair of link elements.

3. A pulling apparatus according to claim 2 wherein said impact end of said linkage means is a first end of each link of said first pair of link elements.

4. A pulling apparatus according to clam 3 wherein each link of said first pair of link elements is pivotally attached at a second opposite end thereof to a first end of a link of said second link pair.

5. A pulling apparatus according to claim 4 wherein each link of said first link pair is pivotally mounted to said housing at a location between said first and second ends thereof.

6. A pulling apparatus according to claim 4 wherein a second opposite end of each link of said second pair is attached to said connecting means.

7. A pulling apparatus according to claim 6 wherein each link of said first pair is an elongted member which extends in a substantially horizontal direction from said one end of said plunger when said plunger is oriented vertically.

8. A pulling apparatus according to claim 7 wherein each link of said second pair is an arcuate member extending substantially vertically upward from the second end of each first link and curving toward the path of travel of said connecting means to a final substantially horizontal orientation at which point the second end thereof is attached to the connecting means, said connecting means being secured in a position substantially above said plunger.

9. A pulling apparatus according to claim 5 wherein said opposite end of said housing has extending portions thereon at which location said first link pair is pivotally connected to the housing.

10. A pulling apparatus according to claim 2 wherein said opposite end of said housing has a groove therein extending substantially through the center thereof and sized to receive at least a portion of said first link pair.

11. A pulling apparatus according to claim 1 wherein said impact end of said linkage means has a recess therein adapted to receive at least a portion of said one end of said plunger.

12. A pulling apparatus according to claim 1 wherein said connecting means further comprises a threaded rod means for attaching one of a plurality of various gripping and holding means thereto.

13. A pulling apparatus according to claim 1 wherein said connecting means further comprises a yoke member.

* * * * *

UNITED STATES PATENT AND TRADEMARK OFFICE

CERTIFICATE OF CORRECTION

PATENT NO. : 4,586,230

DATED : May 6, 1986

INVENTOR(S) : RICHARD HARYDZAK, J. ALAN KRAYKOVIC

It is certified that error appears in the above-identified patent and that said Letters Patent is hereby corrected as shown below:

Column 2, line 66, change "Inwardly" to --inwardly--.

Column 5, line 4, change "clam" to --claim--.

Signed and Sealed this

*Nineteenth* Day of *August 1986*

[SEAL]

*Attest:*

DONALD J. QUIGG

*Attesting Officer*

*Commissioner of Patents and Trademarks*